United States Patent [19]

Saku

[11] 4,314,401

[45] Feb. 9, 1982

[54] SHEATHED HEATING ELEMENT AND SEALING OF SHEATHED ELECTRIC HEATING ELEMENT

[76] Inventor: Isamu Saku, 3-17-6, Minamigaoka, Nisshin-cho, Aichi-gun, Aichi-ken, Japan

[21] Appl. No.: 39,040

[22] Filed: May 14, 1979

[30] Foreign Application Priority Data

Jan. 29, 1979 [JP] Japan ..... 54-8935

[51] Int. Cl.[3] ..... H05B 3/00

[52] U.S. Cl. ..... 29/611; 29/614; 29/615

[58] Field of Search ..... 29/610, 611, 614, 615; 427/101, 103, 117, 118; 428/390

[56] References Cited

U.S. PATENT DOCUMENTS

| | | | |
|---|---|---|---|
| 2,322,988 | 6/1943 | Wiegand | 29/614 |
| 2,861,162 | 11/1958 | Inthoudt | 29/615 |
| 2,933,805 | 4/1960 | McOrlly | 29/615 |
| 3,492,624 | 1/1970 | Oakley | 29/611 |

*Primary Examiner*—Leon Gilden

*Attorney, Agent, or Firm*—William A. Drucker

[57] ABSTRACT

A method of sealing an electric heating element having an electric heating wire inside a tubular metal sheath and electrically insulated therefrom by a compacted filler, comprises impregnating the filler at and in the vicinity of the end of the sheath with an electrically insulative solution and compressing the sheath in said vicinity such that said electrically insulative solution substantially permeates the interstices within the impregnated filler.

9 Claims, 20 Drawing Figures

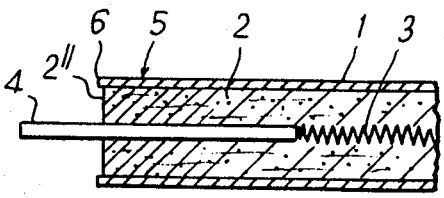
FIG. 1
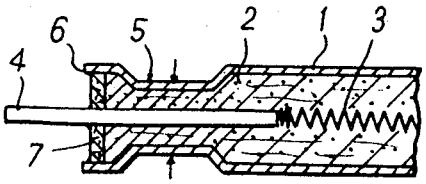
FIG. 2
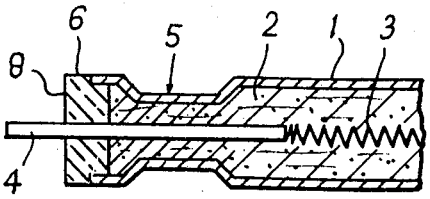
FIG. 3
FIG. 4
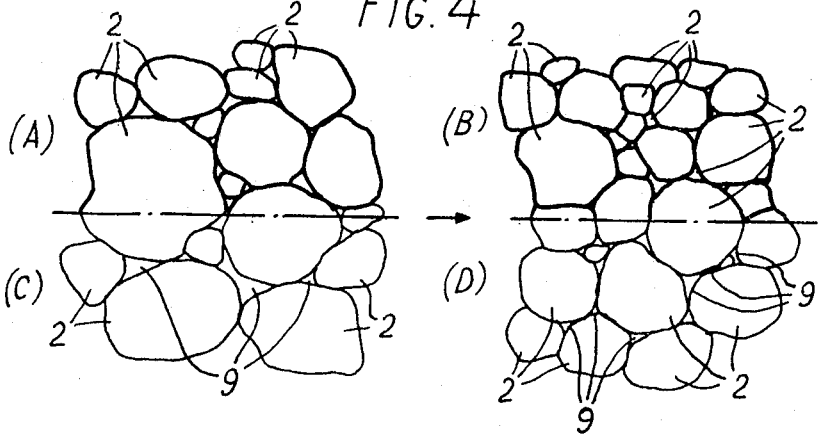

SHEATHED HEATING ELEMENT AND SEALING OF SHEATHED ELECTRIC HEATING ELEMENT

BACKGROUND OF THE INVENTION

1. Field of the Invention

This invention relates to electric heating elements and in particular relates to the sealing of an electric heating wire within the tubular metal sheath of the element.

2. Description of the Prior Art

Metal sheathed electric heaters are well known in the art and primarily consist of an electrical resistance wire which acts as the heater for the element. The resistance wire is generally disposed along the axis of the tubular sheath and is electrically insulated therefrom by an insulating filler which is packed into the surrounding space around the wire. This prevents relative movement between the wire and the sheath and enables heat generated in the wire to be transmitted to the sheath.

In order to prevent deterioration of the filler, it has been essential to seal the ends of the sheath to prevent the ingress of air and moisture. It is known to seal the ends of the sheath in a number of ways; a seat of suitable insulating material may be secured in the site and, if necessary, providing a heat resistant insulating material such as an epoxy resin between the seat and the inner filler. Alternatively, a seat may not be required but instead the sheath ends may be sealed directly with a heat-resistant insulating material such as a silicone varnish, glass seal, silicone rubber or an epoxy resin.

However a residual problem remains in that, over extended use and/or storage of the heating elements, air and moisture still find their way through the seals thereby still resulting in deterioration in the insulating property of the filler.

SUMMARY OF THE INVENTION

It is therefore an object of this invention to reduce still further this problem by providing a method of sealing which results in a seal having a substantially higher degree of air- and moisture-tightness.

It is also an object of the invention to be able to carry out the method of the invention in an economical fashion thereby not substantially altering manufacturing costs of electric heating elements embodying the invention.

BRIEF DESCRIPTION OF THE DRAWINGS

FIG. 1 is an axial section, with parts shown in elevation, of a seed heater made using the method of the invention;

FIG. 2 is an axial section, with parts shown in elevation, of an end portion of a seed heater after a stage of compression;

FIG. 3 is an axial section, with parts shown in elevation, similar to FIG. 2, but with a different sealing material at the end of the heater;

FIG. 4 is a schematic elevation of grains of filler material, the portions (A) and (B) of the figure showing the filler in accordance with the invention, and the portions (C) and (D) representing prior art;

DESCRIPTION OF THE PREFERRED EMBODIMENTS

In FIG. 1 there is shown a seed heater which, for the purposes of this specification, is a term referring to electric heating elements, usually made up as straight lengths which are then stored pending a particular application. For example, they may be made up into a spiral element with special terminals to satisfy a particular appliance manufacturer's requirements.

Figure 6:
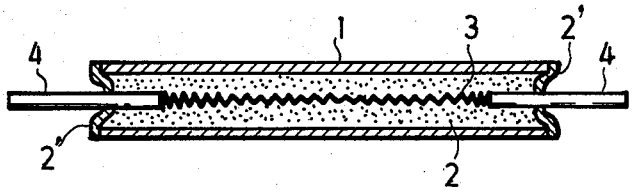
FIG. 6 is an axial section, with parts shown in elevation, of a heater with its sheath ends temporarily closed.
Figure 7:
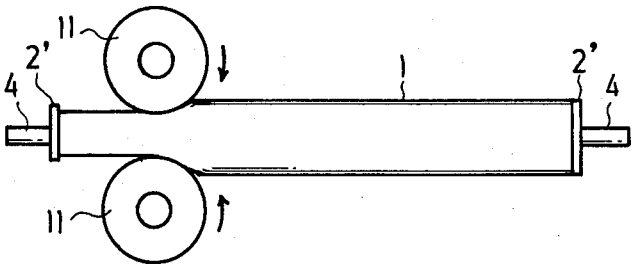
FIG. 7 is a side elevation showing a stage of compression of an end portion of the heater by rollers.
Figure 8:
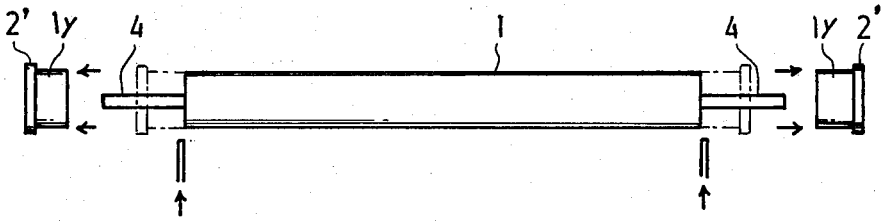
FIG. 8 is a side elevation showing a subsequent stage of removal of end portions of the heater.
Figure 9:
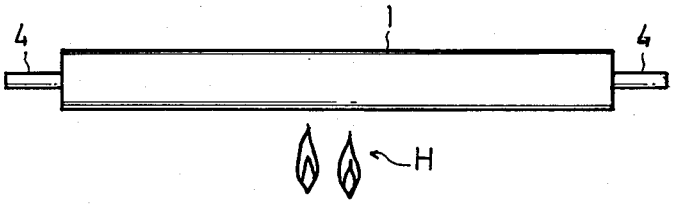
FIG. 9 is a side elevation showing schematically a stage of annealing by heating.

The seed heater consists of a heating wire 3 connected to a terminal rod 4 which are first inserted into the element sheath 1 and then have filler 2 packed around them. It will be noted that the sheath 1 is formed of a known suitable heat-resisting hard material such as stainless steel or copper, aluminum and the like. The filler 2 used here includes suitable insulative powder such as known magnesia oxide. The heating wire 3 used here includes a known nichrome wire or other materials which generate heat by energization thereof. Both ends of the sheath are temporarily closed off using closure plates 2' as shown in FIG. 6. The diameter of the sheath is then reduced say, by, rollers 11 as schematically shown in FIG. 7 thereby compressing the sheath 1 and the filler 2. In this way the density of the filler 2 is increased due to compaction and the heating wire 3 is thereby substantially secured in its position. A partly together with its associated closure plate 2' is cut off and removed from each end as shown in FIG. 8 and if necessary annealing work is carried out on the element, as figuratively shown in FIG. 9, by heat source H. This stage completes the production of the seed heater of FIG. 1 which is also known as the "sheathed heater blank".

Figure 10:
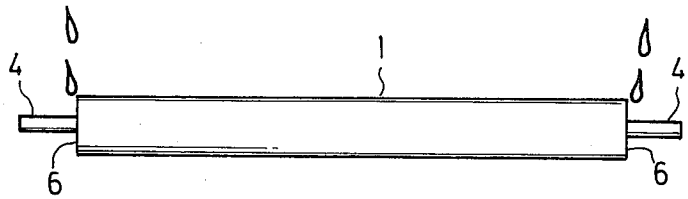
FIG. 10 is a side elevation showing schematically a stage of introduction of insulating solution.

The seed heater is now ready for various steps in the sealing procedure and the first step is to introduce an insulating solution to the filler 2 in the vicinity of the open ends 6 as schematically shown in FIG. 10. The insulating solution is allowed to permeate the filler as represented in FIG. 1 and in other figures as oblique hatching in the neighbourhood of filler 2 adjacent to the open ends 6. Methods for carrying out this permeation step are various and may include the following:

(1) dipping the ends 6 into a vessel containing the insulating solution so as to enable the solution to permeate the interstices of the filler grains to a depth indicated by the oblique hatching in area 5;

(2) spraying the insulating solution onto the end surfaces 2'' of the filler 2 using liquid spray nozzles to enable permeation to take place;

(3) applying the insulating solution with a brush to the surfaces 2'' to achieve permeation; and so forth.

Suitable insulating solutions are required to have sufficient mobility to permeate the interstitial space between the grains of the filler 2 as well as to retain the insulative property of the filler at the operating temperatures of the heating wire 3. Examples of such solutions include a variety of silicone oils and silicone varnishes which are currently commercially available. The depth of permeation is preferably within the range 1–3 cm from surface 2'' for most cases, but deep penetration may be required in some other cases depending on the inner sectional area of the sheath 1 and the material of filler 2. In some other cases sufficient sealing effect may be obtained by only slight penetration of the solution. The depth of penetration may be determined empirically by experimentation.

Figure 11:
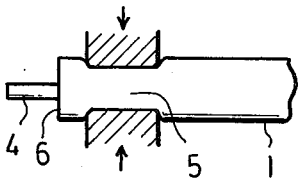
FIG. 11 is a side elevation, with parts shown in section, to illustrate a stage of compression of the element adjacent its end.

Upon completion of the permeation step or otherwise, the sheath 1 is again compressed in the vicinity of area 5 using, for example, a press or swaging technique as shown in FIG. 11. As particularly shown in the embodiment of FIG. 11, the compression takes place a short distance in from ends 6. As a result, the density of the filler 2 in the compressed portion of area 5 is further increased as shown in FIG. 2. It should be noted that the position of the compression avoids the outer circumference of the heating wire 3 and, also, the sheath 1 is constructed at a position that does not adversely affect its strength, for example, at the portion of the sheath around the outer circumference of the terminal rod 4.

The effect of this sealing procedure is illustrated in FIG. 4 which shows a macroscopic representation of the filler grains 2 in four different conditions. In FIG. 4 (C), the grains 2 prior to compression have appreciably-sized interstices 9 between them and upon compression the density of the grains is increased as in FIG. 4 (D) but the interstices 9 are still present, albeit smaller in size. This is the condition known to the prior art. However FIG. 4 (A) corresponds to FIG. 4 (C) except that the insulating solution has now been introduced and has permeated and adhered to the surface of the grains 2. Upon compression, the solution then effectively fills the interstices 9 between the grains 2 as shown in FIG. 4 (B) thereby providing a high degree of airtightness.

Figure 5:
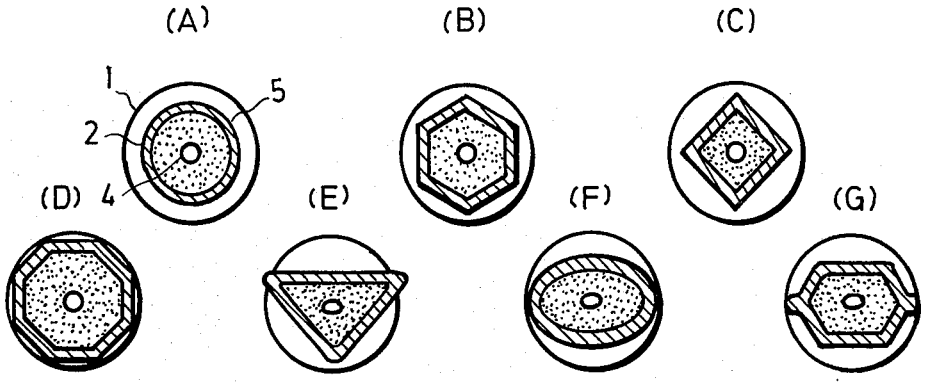
FIGS. 5(A) to (G) are radial cross-sections, taken at the compressed area 5, to show various configurations.

The effectiveness of the above sealing method is not limited to recompression in a circular mode and in fact a variety of cross-sectional shapes may be employed, depending on applications, as, for example, those shown in FIGS. 5 (A) to (G). After the insulating solution is in the state as shown in FIG. 4 (B), the element is finally sealed with some heat resisting material 7 such as a silicone resin or an epoxy resin, or heat resisting material such as a porcelain 8 or a silicone rubber as shown in FIG. 3. This final sealing may if required take place before the state shown in FIG. 4 (B), that is in the state 4 (A), and after the final sealing is accomplished the constriction at area 5 may be carried out to effect the condition shown in FIG. 4 (B).

Figure 12:
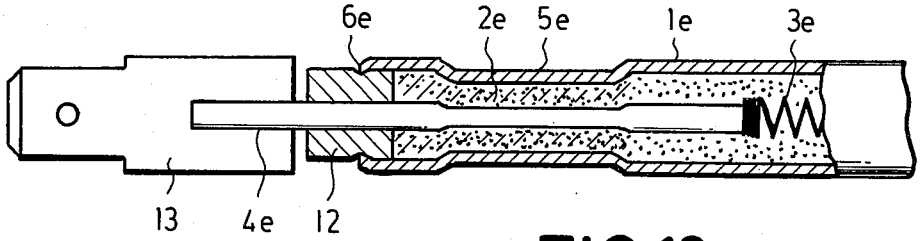
FIG. 12 is an axial section, with parts shown in elevation, of another embodiment of heater with a terminal fitted.

FIG. 12 illustrates an embodiment wherein a heat-resistant insulating bushing such as a silicone rubber bushing 12 is fitted into the opening **6*e* and the opening 6*e* is reduced in diameter so that the bushing 12 may be secured to the sheath 1*e* after the permeation and compression stages are completed. A terminal 13 is secured to the end of rod 4*e*. In FIG. 12 and in subsequent FIGS. 13–15 and 17–20**, alphabetical suffixes are employed to identify like members carrying the same numerical references so as to avoid redundancy.

Figure 13:
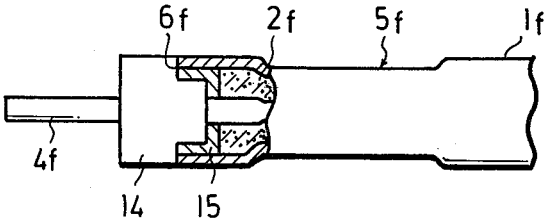
FIG. 13 is a side elevation, with parts shown in section, of yet another embodiment of heater.

FIG. 13 shows another embodiment wherein a heat-resistant insulating material such as epoxy resin 15 is interposed between the heat-resistant insulating bushing 14, which is fitted into the opening **6*f*, and the filler 2*f***.

Figure 14:
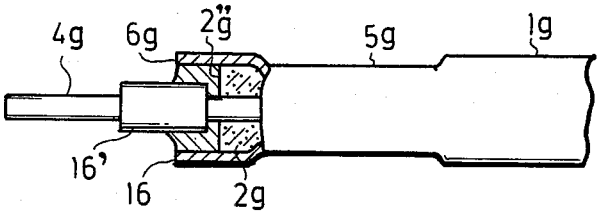
FIG. 14 is a side elevation, with parts shown in section, of a still further embodiment of heater.

FIG. 14 shows a further version wherein an insulating bushing 16' of smaller diameter than that of the sheath is fitted into the same heat-resistant insulating material 16 as in FIG. 13 but is fully packed with epoxy resin from the end surface **2''*g* of the filler 2*g* up to opening 6*g***.

Figure 15:
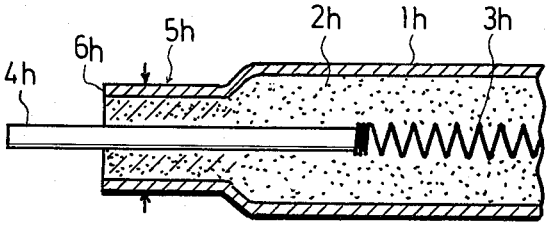
FIG. 15 is an axial section, with parts shown in elevation, of yet another embodiment of heater.
Figure 16:
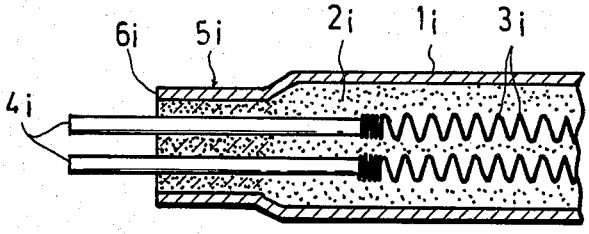
FIG. 16 is an axial section, with parts shown in elevation, of a still further embodiment of heater.

FIG. 15 provides a departure from the recompression application discussed above in that, after permeation of the insulating solution, the recompressed portion **5*h* is constricted up to the opening 6*h*. This arrangement is further exemplified in FIG. 16 which shows a pair of terminal rods 4*i* extended from the open end 6*i* such as would be encountered in a cartridge heater. In a fashion similar to that of FIGS. 2 & 15, this arrangement shows that it is possible to convert the filler 2*i* into an airtight seal merely by constricting the end portion 5*i*** after the permeation process has been applied.

Figure 17:
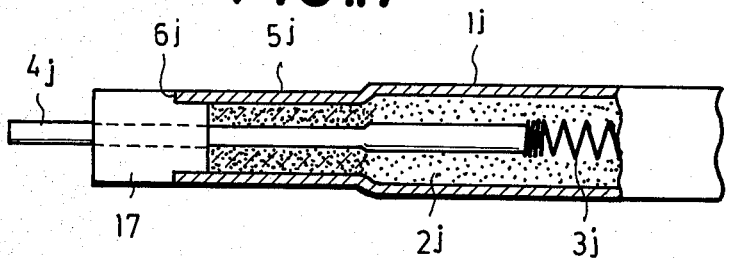
FIG. 17 is an axial section, with parts shown in elevation, of a still further embodiment.

FIG. 17 shows that the recompression arrangement of FIG. 15 may also be adapted to permit the insertion of an insulating bushing 17 into the end opening **6*j* in an analogous fashion to that of FIG. 13** without the interposed epoxy resin.

Figure 18:
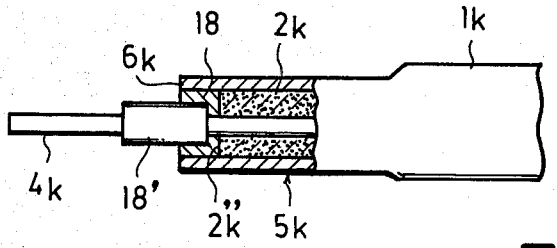
FIG. 18 is a side elevation, with parts shown in section, of a still further embodiment.

Next, FIG. 18 shows an embodiment wherein there is provided an end **5*k* recompressed up to an opening 6*k* similarly to FIG. 15, a small-diameter insulating bushing 18' is mounted similarly to FIG. 14, and a heat-resisting insulator 18 is filled from an end surface 2''*k* of the filler 2*k* to the opening 6*k***.

Figure 19:
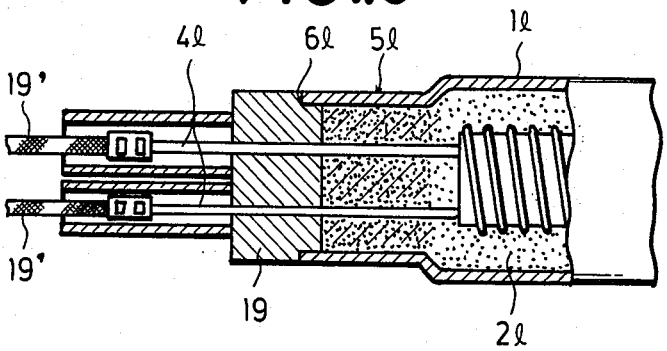
FIG. 19 is an axial section, with parts shown in elevation, of a still further embodiment.
Figure 20:
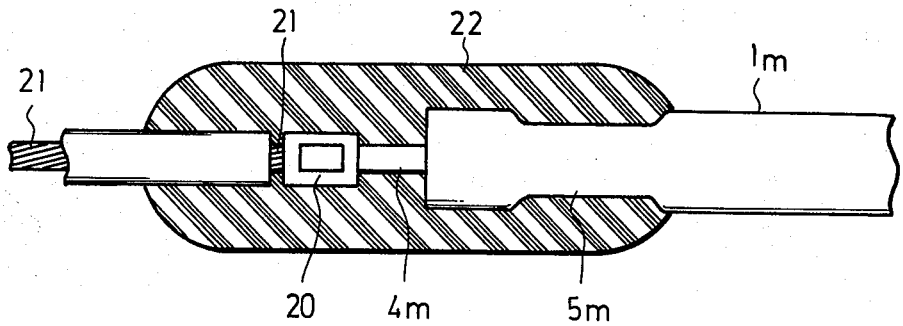
FIG. 20 is a side elevation of part of a heater element having a terminal rod, lead wire and connector enclosed within a rubber moulding.

A further embodiment is illustrated in FIG. 19, wherein recompression after the type shown in FIG. 15 has taken place after permeation and two (or more) terminal rods **4*l* are provided. A heat-resistant insulating plug 19 is inserted and wire leads 19' are connected to the terminal rods 4*l*. In FIG. 20, the terminal rod 4*m* together with the lead wire 21 and connector 20 are fully enclosed within a rubber moulding 22. However, the moulding 22** is still known to be gas and moisture permeable in time and hence the invention again is advantageous in such embodiment.

It should be apparent to those skilled in the art that the method of the present invention provides a characteristically high sealing effect for metal sheathed electric heating elements employing a filler, such as magnesium oxide. The method is simple to apply industrially and, because of its stated advantages, is economically desirable.

What I claim is:

1. A method of sealing an electric heating element having an electric heating wire inside a tubular metal sheath and electrically insulated therefrom by a compacted filler, said method comprising:

impregnating the filler at and in the vicinity of the end of the sheath with an electrically insulative solution; and compressing the sheath in said vicinity such that said electrically insulative solution substantially permeates the interstices within the impregnated filler.

2. A method as claimed in claim 1 wherein said electrically insulative solution is a silicone electrically insulative solution.

3. A method as claimed in claim 1 wherein the compressing of said sheath does not include compressing said end.

4. A method as claimed in claim 1 wherein said end is further sealed with a heat-resistant insulating material which does not effectively penetrate said impregnated filler.

5. A method as claimed in claim 4 wherein said end is additionally sealed with a heat-resistant insulative bushing.

6. A method as claimed in claim 1 wherein said compressing of the sheath includes said end.

7. A method as claimed in claim 1 wherein said impregnating comprises the step of dipping the end into said solution until the impregnation reaches a predetermined depth.

8. A method as claimed in claim 1 wherein said impregnating comprises the step of spraying said solution onto the end until the impregnation reaches a predetermined depth.

9. A method as claimed in claim 1 wherein said impregnating comprises the step of brushing said solution onto the end until the impregnation reaches a predetermined depth.

* * * * *